US010986947B2

(12) United States Patent
Lefferts

(10) Patent No.: US 10,986,947 B2
(45) Date of Patent: Apr. 27, 2021

(54) BEVERAGE UTENSIL WITH IDENTIFICATION COMPONENT

(71) Applicant: S2 Products Inc., West Islip, NY (US)

(72) Inventor: Michelle Lefferts, West Islip, NY (US)

(73) Assignee: S2 Products Inc., West Islip, NY (US)

( * ) Notice: Subject to any disclaimer, the term of this patent is extended or adjusted under 35 U.S.C. 154(b) by 51 days.

(21) Appl. No.: 16/008,508

(22) Filed: Jun. 14, 2018

(65) Prior Publication Data

US 2018/0360246 A1 Dec. 20, 2018

Related U.S. Application Data

(63) Continuation-in-part of application No. 29/607,704, filed on Jun. 15, 2017, now Pat. No. Des. 823,072.

(51) Int. Cl.
*A47G 21/02* (2006.01)

(52) U.S. Cl.
CPC ..... *A47G 21/02* (2013.01); *A47G 2400/06* (2013.01)

(58) Field of Classification Search
CPC ..... A47G 21/02; A47G 2400/06
See application file for complete search history.

(56) References Cited

U.S. PATENT DOCUMENTS 1,477,653 A 12/1923 de la Barre
2,313,977 A 3/1943 Takach
D160,695 S 10/1950 De Fee
D197,478 S 2/1964 Larson
3,224,093 A 12/1965 Huck
D235,307 S 6/1975 Shoemaker
3,906,632 A * 9/1975 Oppenheimer ..... A47J 43/288 30/322
3,911,578 A 10/1975 Ushkow et al.
3,946,652 A 3/1976 Gorin
D256,212 S 8/1980 Richmond
4,338,338 A 7/1982 Popkes
D268,077 S 3/1983 Morin
4,924,444 A 5/1990 Castellanos
5,154,318 A 10/1992 Lampard
D360,450 S 7/1995 Louden et al.
5,481,805 A * 1/1996 Wilson ..... B25G 1/102 30/322
5,491,895 A 2/1996 Lee
D397,503 S 8/1998 Lalli
6,145,204 A * 11/2000 Cash ..... A47G 21/02 30/322
D467,137 S 12/2002 Gross
6,675,482 B1 1/2004 Gilbert, Jr. et al.
D531,827 S * 11/2006 Jelmoni ..... D6/358
D549,526 S * 8/2007 Tanguy ..... D7/653
D579,729 S * 11/2008 Pourounidis ..... D7/637
(Continued)

OTHER PUBLICATIONS

Notice of Allowance issued in U.S. Appl. No. 29/607,704 dated Mar. 22, 2018.

*Primary Examiner* — Omar Flores Sanchez
(74) *Attorney, Agent, or Firm* — Jeffrey T. Placker, Esq.; Alexa Marie J. Derkasch, Esq.; Holland & Knight LLP

(57) ABSTRACT

The present invention is a beverage utensil which contains a receptacle component on one end and an identification component on the opposite end. The utensil is designed such that the receptacle component is capable of stirring the beverage and also for removing solid edible elements from the beverage for consumption by the imbiber of the beverage.

19 Claims, 4 Drawing Sheets

(56) References Cited

U.S. PATENT DOCUMENTS

| | | | | | |
|---|---|---|---|---|---|
| D590,214 | S | | 4/2009 | Cox | |
| D592,058 | S | * | 5/2009 | Rapaport | D7/622 |
| D629,263 | S | * | 12/2010 | Pico | D7/653 |
| D639,372 | S | * | 6/2011 | Zelekovitz | D21/793 |
| D645,105 | S | * | 9/2011 | Schauffele | D21/793 |
| D645,106 | S | * | 9/2011 | Schauffele | D21/793 |
| D645,107 | S | * | 9/2011 | Schauffele | D21/793 |
| D645,108 | S | * | 9/2011 | Schauffele | D21/793 |
| D645,927 | S | * | 9/2011 | Schauffele | D21/793 |
| 8,091,242 | B2 | | 1/2012 | Teys et al. | |
| D700,021 | S | | 2/2014 | Arnold | |
| D721,559 | S | | 1/2015 | Grinalds et al. | |
| 9,114,289 | B1 | * | 8/2015 | Bradshaw | A63B 57/50 |
| 9,434,060 | B1 | | 9/2016 | Grinalds et al. | |
| D823,072 | S | | 7/2018 | Lefferts | |
| 2003/0029044 | A1 | * | 2/2003 | Mattson | A47G 21/02 30/324 |

* cited by examiner

BEVERAGE UTENSIL WITH IDENTIFICATION COMPONENT

CROSS REFERENCE TO RELATED APPLICATIONS

The present application is a continuation-in-part of U.S. patent application Ser. No. 29/607,704 filed on Jun. 15, 2017.

FIELD OF THE ART

The present invention relates to a utensil for use in beverages. More specifically, the present invention relates to a utensil for use in beverages containing solid edible components. Even more specifically, the present invention is related to a Sangria spoon that is capable of stirring the beverage and drawing fruit or other solid edible foods from the beverage via a receptacle component shaped as a spoon head and/or spork head on one end of the utensil. Additionally, the present invention possesses an identification component on an end of the utensil opposite the receptacle component.

BACKGROUND ART

Many types of spoons and/or stirrers are known in the field of utensil ware. Stirring devices have been known, such as U.S. Pat. No. 4,924,444. Examples of stirring devices can be found in U.S. Pat. No. 1,477,653 disclosing an elongated shaft having a rectangular blade pivotally attached at a distal end thereof. U.S. Design Pat. No. 197,478 discloses a food stirring implement with an elongated shaft and a rectangular stirring blade. U.S. Design Pat. No. 235,307 discloses a combined spoon and spreading device on opposite ends of an elongated shaft. U.S. Des. Pat. No. 256,212, discloses a combined spoon and chopper having culinary implements provided at opposite ends of an elongated shaft. U.S. Des. Pat. No. 268,077 discloses a stirring device with an elongated flat handle formed with an enlarged stirring blade.

Variations on spoons are known in the art that can be used for dispensing of medicine or other ingredients. The spoons generally are designed to dispense ingredients from the bowl of the spoon with the ingredients stored in the spoon handle (such as U.S. Pat. Nos. 8,091,242, 6,675,482, 5,491,895 and 5,154,318) or within the bowl of the spoon (such as U.S. Pat. Nos. 3,911,578, 3,946,652 and 4,338,338). These spoons are expensive to manufacture, not suitable for reuse, and do not provide the needed stirring and grasping functions of the present invention.

The present invention provides advantages over the known prior art by combining multiple utilities and by further adding the improvement of a customizable identification component.

SUMMARY OF THE INVENTION

The present invention relates to a beverage utensil which contains a handle with two distal ends. One end of the handle contains a receptacle component and the opposite end of the handle contains an identification component. The beverage utensil is designed such that the receptacle component is capable of stirring the beverage and also for removing solid edible elements from the beverage for consumption by the imbiber of the beverage. The receptacle component is preferably shaped with the head of a spoon or spork with multiple prongs designed to spear and/or grasp solid edible elements in the beverage. The receptacle component can have different configurations, such as the head of a fork, knife, whisk, and variations thereof.

The identification component of the present invention allows for customization of the beverage utensil. One use of the customization is that it allows the beverage utensil to be used for advertising of the establishment selling the beverages. Non limiting examples of locations where such advertising can be beneficial include restaurants, bars, catering halls, amusement parks, and any establishment that serves beverages. A very specific example will be establishments that sell beverages containing fruit or other edible elements, such as sangria. The establishment will be able to place their name logo, picture, or design, such as the name of the establishment on the identification component of the beverage utensil. Further, the identification component can be designed to not just include images, lettering or pictures, but can be made into any shape. Non-limiting examples of shapes include a baby, wedding rings, a cross, a diamond, a heart, a square, a circle, an oval, fruit, car, airplane, animals, letters, or whole names. The beverage utensil can also be sold wholesale or on-line or in retail stores directly to consumers. Further, when the beverage utensil is sold directly to consumers it can be further customized or personalized to include things such as personal pictures, names, dates, or any type of personalization chosen by the consumer.

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Figure 1:
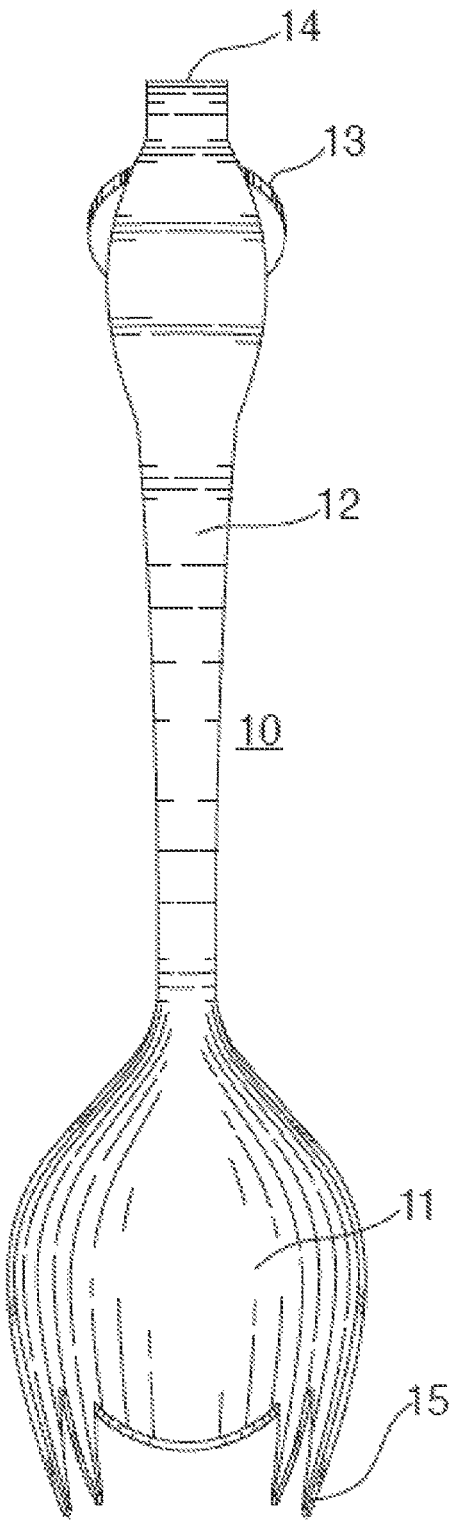
FIG. 1 is the front of an embodiment of the beverage utensil of the present invention.

FIG. 1 shows a utensil 10 shown having a receptacle component 11 and a handle 12. The receptacle component 11 contains multiple prongs 15 located on the distal end of the receptacle component 11. At the opposite end of the handle 12 from the receptacle component 11 is the identification component 13. The embodiment shown in FIG. 1 shows a bend 14 in the handle 12 located between the receptacle component 11 and a circular embodiment of the indentation marker 13. FIG. 1 shows the front portion of a concave receptacle component 11. FIG. 1 also shows the front portion of the handle. The bend 14 in the handle 12 in the embodiment shown in FIG. 1 is closer to the identification component 13 than to the receptacle component 11. Variations on the location of the bend 11 are within the scope of the present invention.

The receptacle component shown in FIG. 1 contains a front portion and a back portion, wherein the front portion is generally concave forming a region similar to that of the bowl in a head of spoon which will allow solid element to be brought out of the beverage. The back portion of the receptacle component will be generally convex. The receptacle component of the present invention can have varying levels of concavity and/or be flat. Variations in the shape and configuration of the receptacle component are within the scope of the present invention.

The receptacle component is located at a distal end of the handle of the beverage utensil. At the opposite end of the handle is the identification component.

The handle further comprises a bend in the handle that creates a hook or angle or bend in the handle that is configured for and capable of engaging a top side wall edge of a beverage container. The bend is generally at an angle of less than 90°, and the angle is opposite the front portion of the receptacle component. This creates an configuration in which the beverage utensil can be rested on an edge of the beverage, and the beverage utensil will rest vertically (from the top portion of the beverage to the bottom portion of the beverage), with the concave portion of the receptacle component facing away from the side wall of the beverage (i.e., towards the center of the beverage container). The angle of the bend in the handle can be any angle less than 90°, but generally will be chosen to allow for the beverage utensil to easily be rested on the top side wall edge of the beverage container without falling into the beverage and without being tightly wedged around the top side wall edge (i.e., not too small an angle of the bend, such as less than) 5-10°. Preferably the angle of the bend will be about 45°. Further, the above described configuration of the bend in the handle allows the front portion of the identification component, where the customization is directly visible, to be displayed.

Figure 2:
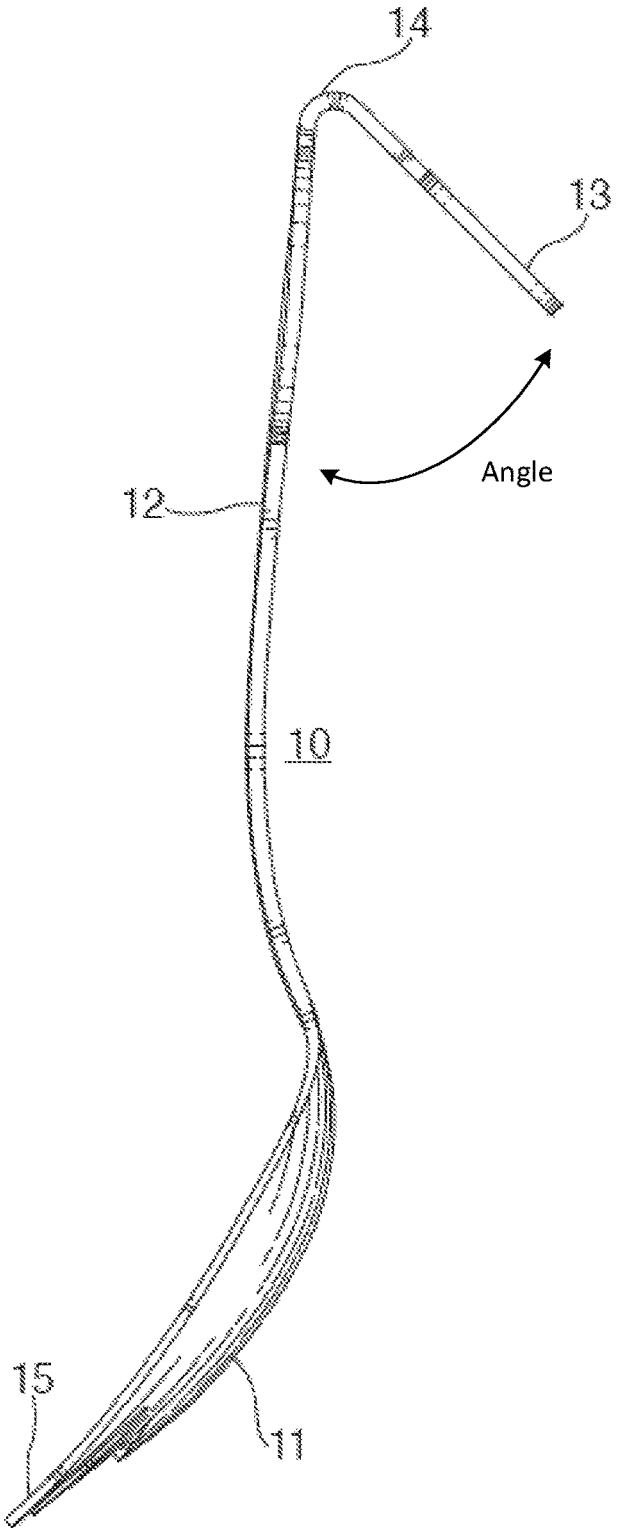
FIG. 2 is the left side of an embodiment of the beverage utensil of the present invention.

FIG. 2 is a side view of an embodiment of a utensil 10 of the present invention. FIG. 2 shows the receptacle component 11 with multiple prongs 15 located on the receptacle component 11.

Further, FIG. 2 show a circular embodiment of the identification component 13 opposite the receptacle component 11. Additionally, the embodiment shown in FIG. 2 shows a bend 14 in the handle 12 located between the receptacle component 11 and the indentation marker 13. The bend 14 creates a ledge that is configured for resting the utensil 10 on the edge of a beverage.

Figure 3:
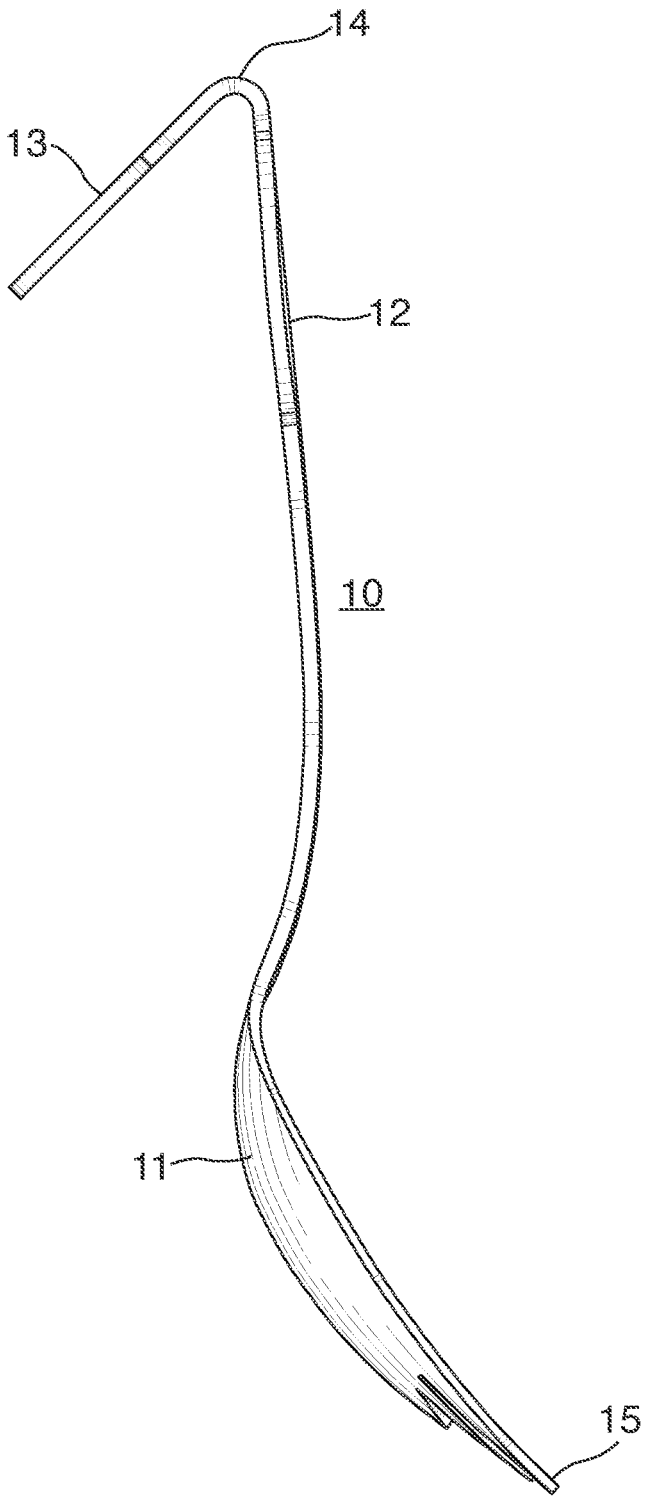
FIG. 3 is the right side of an embodiment of the beverage utensil of the present invention.

FIG. 3 is an opposite side view (from FIG. 2) of an embodiment of a utensil 10 of the present invention.

Figure 4:
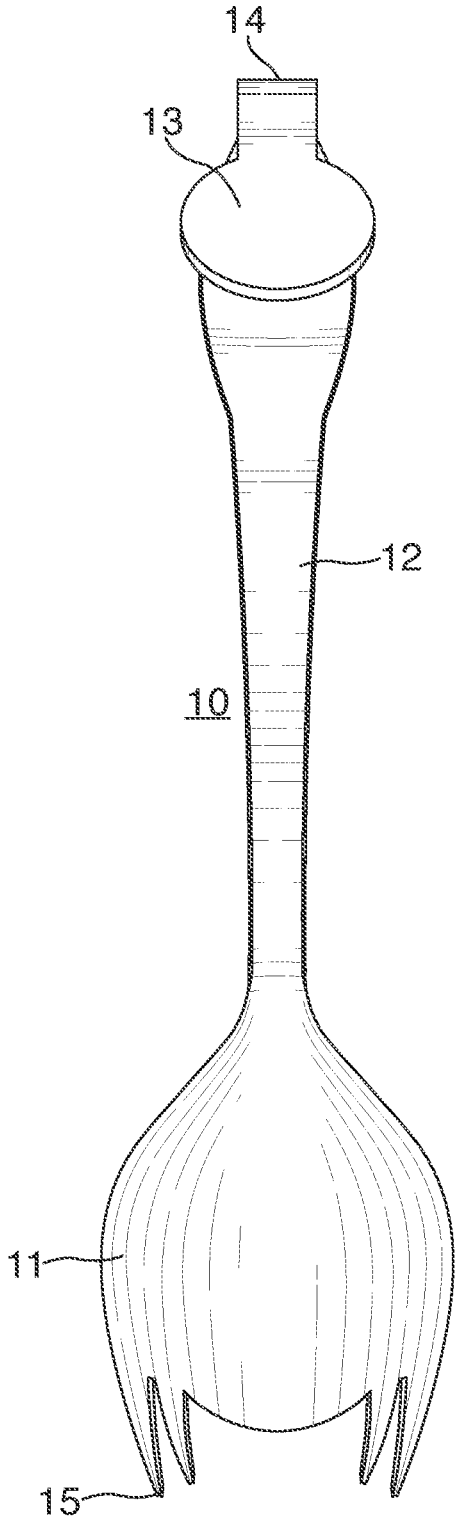
FIG. 4 is the rear of an embodiment of the beverage utensil of the present invention.

FIG. 4 is a back view of an embodiment of a beverage utensil 10 of the present invention. FIG. 4 shows the front side of a circular configuration of the indentation marker 13 to which the personalization or customization is applied or constructed, such, but not limited to, a logo, name, or other marking. This use of the identification component allows for the customization of the utensil for the consumer/establishment/purchaser.

Figure 5:
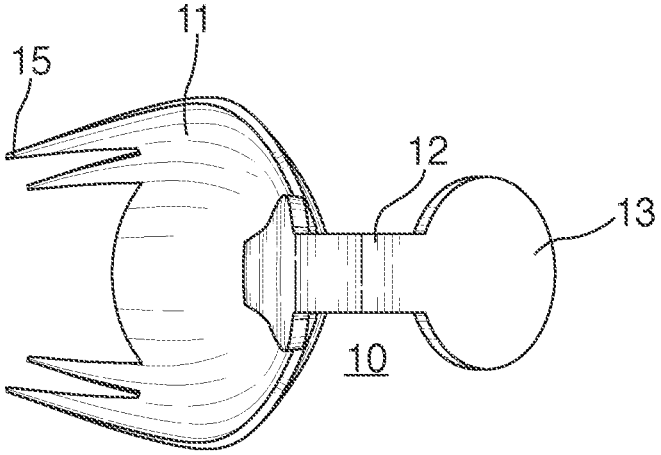
FIG. 5 is the top of an embodiment of the beverage utensil of the present invention.

FIG. 5 is a top view of an embodiment of a beverage utensil 10 of the present invention.

Figure 6:
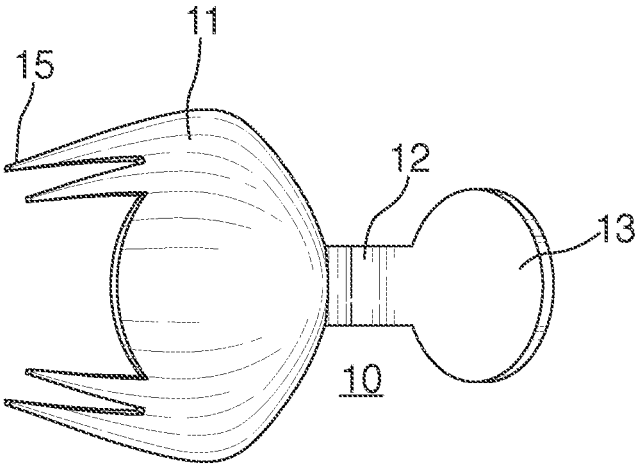
FIG. 6 is the bottom of an embodiment of the beverage utensil of the present invention.

FIG. 6 is a bottom view of an embodiment of a beverage utensil 10 of the present invention.

Figure 7:
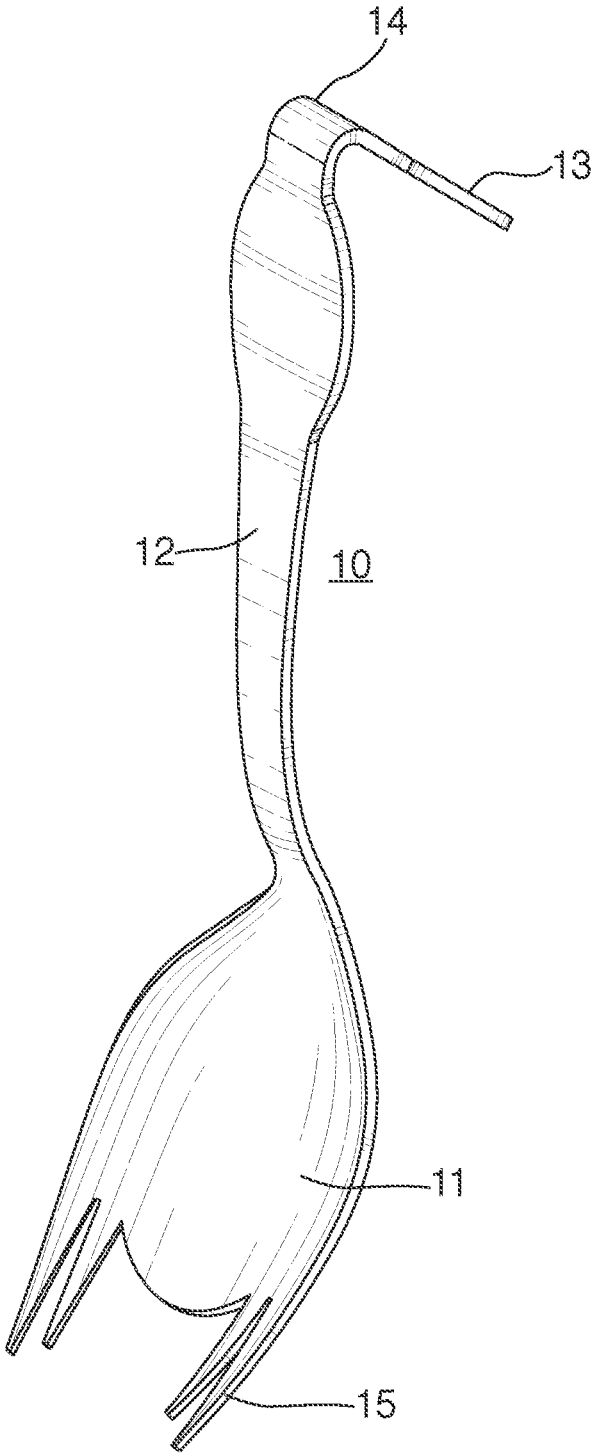
FIG. 7 is the perspective of an embodiment of the beverage utensil of the present invention.

FIG. 7 is a perspective view of an embodiment of a beverage utensil 10 of the present invention.

An embodiment of the present invention is a beverage utensil comprising a:

a receptacle component, wherein said receptacle component comprises a front portion and a back portion;

an identification component, wherein said identification component comprises a front portion and a back portion; and a handle extending between said receptacle component and said identification component, wherein said handle contains a front side and a back side;

wherein the receptacle component is located at a distal end of the handle and the identification component is located at an opposite distal end of the handle;

wherein said handle is bent at an angle opposite the front side of the receptacle component forming a bend in the handle configured for resting said beverage utensil on a top side wall edge of a beverage container.

Another embodiment of the present invention is a method of customizing beverage utensils wherein said beverage utensil comprises

- a receptacle component, wherein said receptacle component comprises a front portion and a back portion;
- an identification component, wherein said identification component comprises a front portion and a back portion; and
  - a handle extending between said receptacle component and said identification component, wherein said handle contains a front side and a back side;
  - wherein the receptacle component is located at a distal end of the handle and the identification component is located at an opposite distal end of the handle;
  - wherein said handle is bent at an angle opposite the front side of the receptacle component forming a bend in the handle configured for resting said beverage utensil on a top side wall edge of a beverage container;

said method further comprising selecting a customization for the identification component wherein said customization is selected from the group consisting of a name, a picture, a logo, a shape.

Embodiments of the present invention comprises a beverage utensil further comprising a handle with two distal ends, where one ends contains a receptacle component and the opposite end contains an identification component. The utensil is designed such that the receptacle component is capable of stirring the beverage and also for removing solid edible elements from the beverage for consumption by the imbiber of the beverage. The receptacle component can be made in any shape such as the head of a spoon, fork, and/or spork allowing for ease of use by the imbiber. The receptacle component can have multiple or a plurality of prongs or no prongs for grabbing and/or stabbing the solid edible elements in the beverage. The receptacle component is located on one end of the handle of the utensil. The handle is generally an elongated and narrow flat component that stretches from the receptacle component to the indentation marker opposite the receptacle component.

The identification maker located opposite from the receptacle component is easily customizable to any shape or size desired by the consumer. Preferably the indentation marker is located distal from a bend or angle in the handle of the utensil. The bend or angle in the handle of the utensil creates a ledge for the utensil which is configured for resting the utensil on the edge of the beverage while the utensil is in the hand of the imbiber or while transporting the beverage to the imbiber. Preferably the bend or angle in the handle is closer to the identification component end of the utensil than the receptacle end of the utensil. Variations in the location of the bend and the angle of the bend are within the scope of the present invention.

The overall design and shape of the beverage utensil will be as described above, but the size of the beverage utensil can be adapted to fit any beverage container such as extra small, small, medium, large, or extra-large cups, glasses, pitchers, and/or bowls. Variations in the size of the beverage utensil are within the scope of the present invention.

Further, the width of the handle of the beverage utensil can be adapted to the needs of the consumer and the shape or size of the beverage container (or distribution container) for which the utensil has been designed. The handle can be wide, narrow, and/or varying in width along its length.

The shape of the identification component can be any shape desired by the consumer, purchaser, and/or establishment. Examples of shapes include, stars, diamonds, circles, squares, crosses, food shapes (such as types of fruit, e.g., apple, strawberry, watermelon, orange, etc.), teardrops, or a star of David.

The length and number of the prongs on the receptacle component can be varied. They can be short, medium, long or any variation therein. Additionally, the prongs can be of varying lengths on a single beverage utensil. The differing lengths can be employed to grasp different types/sizes of fruit. Further, the arrangement of the prongs can be varied such that there are multiple, such as two prongs on either side of the distal end of the receptacle component (such as in FIG. 1), or one prong on each side of the receptacle component, or continuous prongs across the receptacle component. Additional variations are within the scope of the present invention.

Additional components can be attached to the beverage utensil, one such example would be an element that can be attached to the identification component to provide additional customization.

Items that can be added include, but are not limited to, stickers, pictures, engravings, or similar items.

The beverage utensil can be any color or combination of colors.

The beverage utensil can be used at commercial establishments, reception halls, personal homes, vacation locations, parks, beaches, or anywhere that beverages are enjoyed.

The receptacle component of the beverage utensil is generally designed so that is fits into a human mouth, however the receptacle component can be larger than the human mouth when the beverage utensil is an enlarged size so as to fit in a large bowl, such as a punch bowl from which the beverage can be distributed. The receptacle component can be shaped so that the portion of the receptacle which enter the imbiber's mouth is shallower and tapered to fit more easily and comfortably into the human mouth.

The beverage utensil will generally be constructed of food grade material or stainless steel. Preferably the food grade material will be a plastic, allowing it to survive pasteurization and/or sterilization processes without negative effects. The food grade material can be any material commonly used in flatware, utensils, and/or cutlery, including but not limited to silver, bronze, gold, aluminum, or variations thereof. The prongs, when employed, of the receptacle component of the beverage utensil are designed to have edges that are sharp enough to pierce fruit, but no so sharp to cause damage to the human mouth.

The beverage utensil can be constructed using a mold press or other similar techniques for preparing plastic utensil/cutlery. After the beverage utensil are molded from food grade plastic the additional indentation markers can added to the beverage utensil. Finally, the beverage utensils are packaged into a sanitarily lined container which is then sealed until delivery to the consumer. When non-plastic materials are used, techniques common to manufacturing utensils from those types of material will be employed.

In use the imbiber grasps the beverage utensil by the handle and uses it to either stir the beverage or remove edible components from the beverage. The edible components can be removed from the beverage either by placing them on the receptacle component of the utensil or stabbing/grasping them with the prongs of the receptacle component of the utensil.

As described above the identification component can be designed in any shape or size to accommodate the customizations, such as, but not limited to name, image, and/or logo, to be employed on the identification component.

The foregoing description and examples have been set forth merely to illustrate the present invention and are not intended to be limiting. Since modifications of the described embodiments incorporating the spirit and substance of the invention may occur to persons skilled in the art, the invention should be construed broadly to include all variations within the scope of this application, including but not limited to the appended claims and equivalents thereof.

The invention claimed is:

1. A beverage utensil comprising:

a receptacle component, wherein said receptacle component comprises a front portion and a back portion, wherein said receptacle component is in the shape of a head of a spork;

an identification component, wherein said identification component comprises a front portion and a back portion; and a handle extending between said receptacle component and said identification component, wherein said handle contains a front side and a back side, wherein said receptacle component is located at a distal end of said handle and said identification component is located at an opposite distal end of said handle, wherein said handle is bent at an angle opposite said front portion of said receptacle component forming a bend in said handle configured for resting said beverage utensil on a top side wall edge of a beverage container, and wherein said identification component is located on an opposite side of said bend in said handle from said receptacle component, and wherein said angle forming said bend in said handle between said receptacle component and said identification component is not greater than 90° and not less than 5°.

2. The beverage utensil according to claim 1, wherein said receptacle component further comprises a prong.

3. The beverage utensil according to claim 2, wherein said receptacle component further comprises multiple prongs.

4. The beverage utensil according to claim 1, wherein said identification maker is in the shape of an oval.

5. The beverage utensil according to claim 1, wherein said identification maker is in the shape of a square.

6. The beverage utensil according to claim 1, wherein said identification maker is in the shape of a heart.

7. The beverage utensil according to claim 1, wherein said identification maker is in the shape of a circle.

8. The beverage utensil according to claim 1, wherein said identification maker is in the shape of a diamond.

9. The beverage utensil according to claim 1, wherein said identification maker is in the shape of a cross.

10. The beverage utensil according to claim 1, wherein said identification maker is in the shape of a star of David.

11. The beverage utensil according to claim 1, wherein said identification maker is in the shape of a fruit.

12. The beverage utensil according to claim 1, wherein said identification maker is in the shape of a teardrop.

13. A beverage utensil comprising a:

a receptacle component, wherein said receptacle component comprises a front portion and a back portion, wherein said receptacle component is in the shape of a head of a spork;

an identification component, wherein said identification component comprises a front portion and a back portion; and a handle extending between said receptacle component and said identification component, wherein said handle contains a front side and a back side, wherein said receptacle component is located at a distal end of said handle and said identification component is located at an opposite distal end of said handle, wherein said handle is bent at an angle opposite said front portion of said receptacle component forming a bend in said handle configured for resting said beverage utensil on a top side wall edge of a beverage container, and wherein said angle forming said bend in said handle between said receptacle component and said identification component is between 35° and 55°, and said bend is located closer to said identification component than said receptacle component.

14. The beverage utensil according to claim 13, wherein said angle is 45°.

15. The beverage utensil according to claim 13, wherein said beverage utensil is food grade plastic.

16. The beverage utensil according to claim 13, wherein said beverage utensil is stainless steel.

17. The beverage utensil according to claim 13, wherein said beverage utensil is aluminum.

18. The beverage utensil according to claim 1, wherein said bend is located closer to said identification component than said receptacle component.

19. The beverage utensil according to claim 13, wherein said spork has at least one prong located on said distal end of said receptacle component.

* * * * *